US008000615B2

(12) United States Patent
Mizuyama

(10) Patent No.: US 8,000,615 B2
(45) Date of Patent: Aug. 16, 2011

(54) IMAGE FORMING APPARATUS AND IMAGE FORMING METHOD

(75) Inventor: Tetsuhiko Mizuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 336 days.

(21) Appl. No.: 12/403,869

(22) Filed: Mar. 13, 2009

(65) Prior Publication Data

US 2009/0238583 A1 Sep. 24, 2009

(30) Foreign Application Priority Data

Mar. 18, 2008 (JP) ..... 2008-069260

(51) Int. Cl.
*G03G 15/00* (2006.01)

(52) U.S. Cl. ..... 399/12; 399/27; 399/58

(58) Field of Classification Search ..... 399/9, 12, 399/24–29, 53, 58, 61
See application file for complete search history.

(56) References Cited

U.S. PATENT DOCUMENTS 5,974,280 A * 10/1999 Takesue et al. ..... 399/62
5,987,298 A * 11/1999 Muramatsu et al. ..... 399/359
7,509,063 B2 * 3/2009 Kimura et al. ..... 399/27

FOREIGN PATENT DOCUMENTS

JP 2007-148277 6/2007

* cited by examiner

*Primary Examiner* — Hoan Tran
(74) *Attorney, Agent, or Firm* — Dickstein Shapiro LLP

(57) ABSTRACT

In an image forming apparatus, a timer unit measures a time interval between a current time and a time point when previous supply of toner to a developing unit ended and an adjusting unit adjusts an amount of toner to be supplied to the developing unit based on the time interval measured at the timer unit.

10 Claims, 5 Drawing Sheets

FIG. 7
| | TONER SUPPLYING AMOUNT [g/200ms] | | | |
|---|---|---|---|---|
| TONER SUPPLYING INTERVAL [s] | K | Y | C | M |
| a ( Tint < 3 ) | 0.125 | 0.120 | 0.140 | 0.120 |
| b ( 3 < Tint < 10 ) | 0.120 | 0.115 | 0.140 | 0.120 |
| c ( 10 < Tint < 20 ) | 0.105 | 0.112 | 0.135 | 0.115 |
| d ( 20 < Tint < 30 ) | 0.095 | 0.108 | 0.130 | 0.110 |
| e ( 30 < Tint < 60 ) | 0.090 | 0.105 | 0.125 | 0.108 |
| f ( 60 < Tint ) | 0.085 | 0.102 | 0.120 | 0.105 |
FIG. 8A
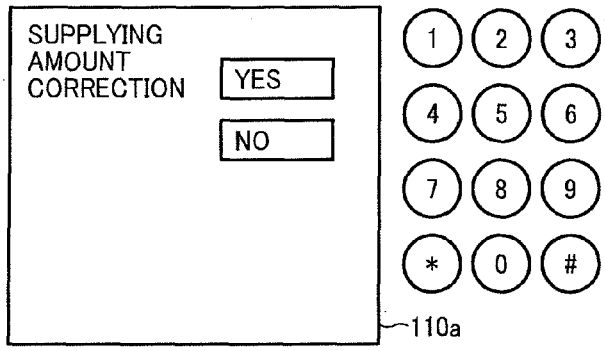
FIG. 8B
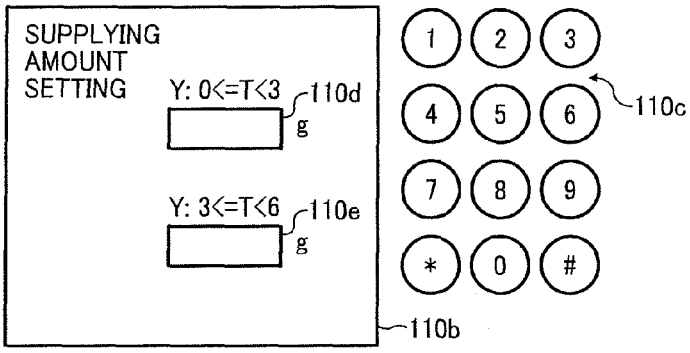

IMAGE FORMING APPARATUS AND IMAGE FORMING METHOD

CROSS-REFERENCE TO RELATED APPLICATIONS

The present application claims priority to and incorporates by reference the entire contents of Japanese priority document 2008-069260 filed in Japan on Mar. 18, 2008.

BACKGROUND OF THE INVENTION

1. Field of the Invention

The present invention relates to a technology for supplying toner in an image forming apparatus.

2. Description of the Related Art

In an electrophotographic image forming apparatus in which a toner image is formed by using a two-component developer, toner is consumed by repeatedly performing an image formation. Therefore, a consumed amount of toner needs to be supplied successively to a developing unit. Typically, toner is stored in a toner container such as a toner cartridge and a toner bottle to be supplied to the developing unit. When the toner container becomes empty, the toner container is replaced by a new one.

Some toner supplying devices employ a powder pump for supplying the toner into the developing unit. Meanwhile, a toner end sensor needs to be provided to the toner supplying device for detecting a toner end. For example, a light transmission sensor is arranged at a vertical portion of a nozzle of the toner supplying device and detects whether the toner container has become empty.

If the image forming apparatus is always operated at normal temperature and normal humidity, the toner can be supplied appropriately. However, under a high temperature and high humidity condition, fluidity of the toner is lowered, which may cause toner blocking or other adverse phenomena inside the toner container. In the toner supplying device employing the powder pump, a toner consumption amount in the developer is estimated by fixing a time period per single driving of the powder pump. In a system having only one toner-supplying time period table, the time period per single driving of the powder pump is short, so that the pressure generated by the powder pump is relatively low. Thus, the toner blocking that has occurred inside the toner container is difficult to remove. The toner blocking causes insufficient supplying of toner, error in detecting the toner end, and the like. The error in detecting the toner end indicates that the toner container is detected to have become empty although the toner still remains therein.

To overcome the drawback mentioned earlier, the applicants have proposed a technology disclosed in Japanese Patent Application Laid-open No. 2007-148277, in which if it is detected that toner does not exist in the toner container, a time period per single driving of a powder pump is increased. With such technology, the toner blocking that has occurred inside the powder container can be removed.

In a toner supplying mechanism that includes a supplying pump, the developing unit and the supplying pump are connected by a conveying path such as a tube. Toner is supplied into the developing unit from the toner container by switching on and off the supplying pump. However, a pressure inside the supplying path is in some cases lowered due to a time interval from a previous toner supply. Due to this, a difference occurs between an actual toner supplying amount and a cumulative toner supplying amount that is calculated. In this case, the toner supplying amount can be increased by increasing the time period per single driving of the supplying pump in the similar manner to the technology mentioned earlier. Although a time period required for the toner end can be delayed, the toner supplying amount cannot be accurately determined. Thus, detection accuracy of the toner near end decreases.

SUMMARY OF THE INVENTION

It is an object of the present invention to at least partially solve the problems in the conventional technology.

According to one aspect of the present invention, there is provided an image forming apparatus that includes a toner supplying unit that supplies toner from a toner container to a developing unit; a timer unit that measures a time interval between a current time and a time point when previous supply of toner by the toner supplying unit to the developing unit ended; and an adjusting unit that adjusts an amount of toner to be supplied by the toner supplying unit to the developing unit based on the time interval measured at the timer unit.

According to another aspect of the present invention, there is provided an image forming method that includes supplying toner from a toner container to a developing unit; measuring a time interval between a current time and a time point when previous supply of toner at the supplying ended; and adjusting an amount of toner to be supplied at the supplying based on the time interval measured at the measuring.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a table indicating a relation between a toner supplying interval and a toner supplying amount for each color; and FIGS. 8A and 8B are schematic diagrams illustrating a supplying-amount correcting screen and a supplying-amount setting screen.

DETAILED DESCRIPTION OF THE PREFERRED EMBODIMENTS

Exemplary embodiments according to the present invention are explained in detail below with reference to the accompanying drawings.

Figure 1:
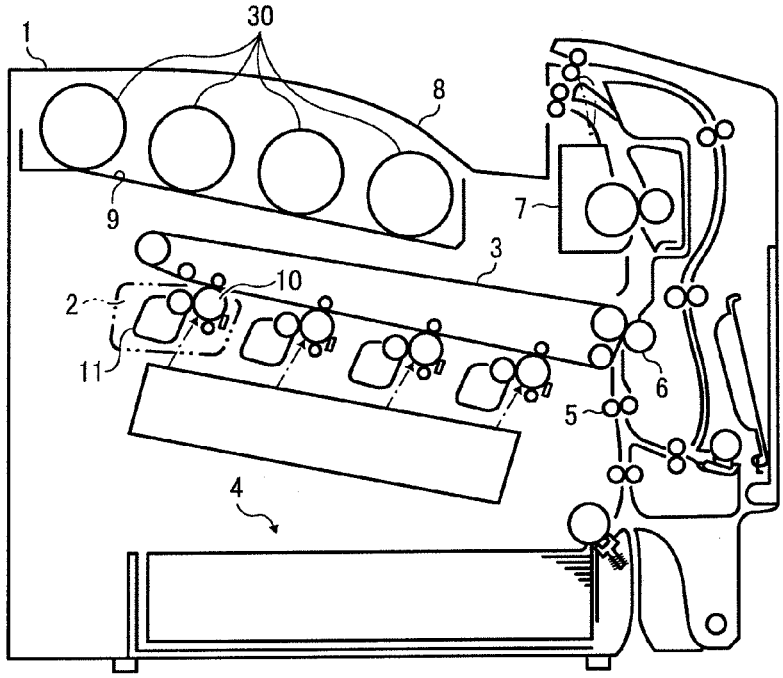
FIG. 1 is a schematic diagram of an image forming apparatus according to an embodiment of the present invention.

FIG. 1 is a schematic diagram of an image forming apparatus according to an embodiment of the present invention. The image forming apparatus is a tandem-type image forming apparatus of an indirect transfer system. In the present embodiment, the image forming apparatus is used as a printer. The image forming apparatus includes a well-known mechanical structure. The configuration of the image forming apparatus is explained. Four imaging units 2 are arranged in a main body 1. An intermediate transfer body 3, which is formed of an endless belt, is arranged opposite each imaging unit 2. The intermediate transfer body 3, which is wound around a plurality of support rollers, runs in a direction of an arrow as shown in FIG. 1. Based on a well-known electrophotographic system, each of a yellow toner image, a magenta toner image, a cyan toner image, and a black toner image is formed on a corresponding photosensitive element 10 in the imaging unit 2. The toner images are sequentially electrostatically transferred onto the intermediate transfer body 3 in a superimposed manner.

A sheet feeding unit 4 is arranged in a lower portion inside the main body 1 of the image forming apparatus. A sheet fed from the sheet feeding unit 4 is conveyed along the conveying path and is sent between the intermediate transfer body 3 and a transferring unit 6 via a pair of registration rollers 5. When the sheet passes through the intermediate transfer body 3 and the transferring unit 6, the toner images superimposed on the intermediate transfer body 3 are transferred onto the sheet. Subsequently, the sheet passes through a fixing unit 7 at which the toner images are fixed on the sheet by heat and pressure. The sheet that has passed through the fixing unit 7 is discharged onto a discharging unit 8.

A setting unit 9 is arranged between the discharging unit 8 and the intermediate transfer body 3 of the main body 1 of the image forming apparatus. Toner cartridges 30 are attached to the setting unit 9. The toner cartridge 30 is a powder storage container that stores therein the toner to be supplied into a developing unit 11 of the imaging unit 2. The toner cartridges 30 are detachably attached to the setting unit 9.

Figure 2:
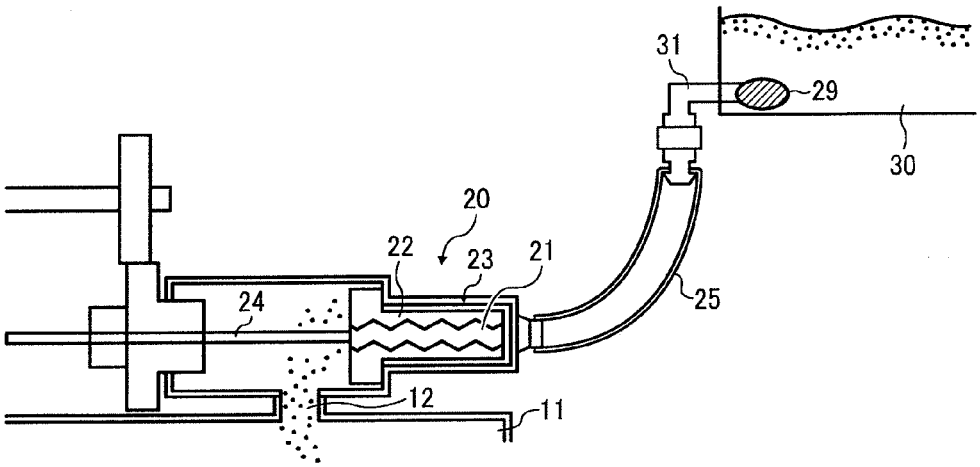
FIG. 2 is a schematic diagram of a toner supplying device that supplies toner from a toner cartridge to a developing unit of the image forming apparatus as shown in FIG. 1.

FIG. 2 is a schematic diagram of a toner supplying device for supplying the toner from the toner cartridge 30 to the developing unit 11 shown in FIG. 1. As shown in FIG. 2, for forming the toner image on the photosensitive element 10 by the developing unit 11 of the image forming apparatus that uses the well-known electrophotographic system, a powder pump 20 of the developing unit 11 is operated to supply the toner in the toner cartridge 30 to the developing unit 11 via a tube 25 that is a toner conveying unit. The tube 25 communicates with the inside of the toner cartridge 30 via a nozzle 31.

The powder pump 20 uses a suction-type single axis eccentric powder pump (commonly known as a mohno pump). The powder pump 20 includes a rotor 21 that is formed in an eccentric screw shape using a material having stiffness such as metal, a fixedly arranged stator 22 in which a double thread hole is formed of rubber, and a housing 23 that is molded of resin or the like, houses the rotor 21 and the stator 22, and forms a powder conveying path. Due to rotation of the rotor 21, strong self-suction force (suction pressure) is generated in the powder pump 20. Due to this, the toner can be sucked from the toner cartridge 30.

The tube 25 has an inner diameter of 4 millimeters to 10 millimeters. For the tube 25, it is extremely effective to use rubber material such as polyurethane, nitrile, EPDM, and silicon that is flexible and excellent in toner resistance properties or plastic material such as polyethylene and nylon. The sucked toner drops into the developing unit 11 from a toner guiding aperture 12 that is arranged in a portion of the developing unit 11. The toner is further conveyed to a developing section by using a stirring screw (not shown). If a two-component developing method is used, the toner (sucked toner) supplied during the conveying process is stirred and mixed with a developer inside the developing unit 11. Due to this, a toner concentration can be uniform and a charge amount of the toner can be appropriate.

For suction conveying the toner by using the powder pump 20, the toner needs to constantly exist in the vicinity of a toner sucking unit 29 indicated by a hatching. Thus, the toner cartridge 30 can be configured to include a coil spring inside thereof or a spiral-shaped projection on an internal wall thereof and convey the toner to a tip of the container by the rotation of the cartridge main body.

In such toner supplying device, conventionally, based on a result of a detection by a magnetic permeability detector (not shown) arranged in a portion of the developing unit 11, a change in a mixing ratio of the toner and a carrier in the developing unit 11 is detected. If it is detected that the amount of the toner is low, the powder pump 20 is operated by rotating a driving shaft 24 of the powder pump 20. When the toner that is conveyed by the powder pump 20 into the developing unit 11 is equal to or more than a predetermined amount, driving of the driving shaft 24 is interrupted by signals from the magnetic permeability detector, thus stopping the operation of the powder pump 20.

Details of toner supplying control according to the present embodiment are explained below.

Figure 3:
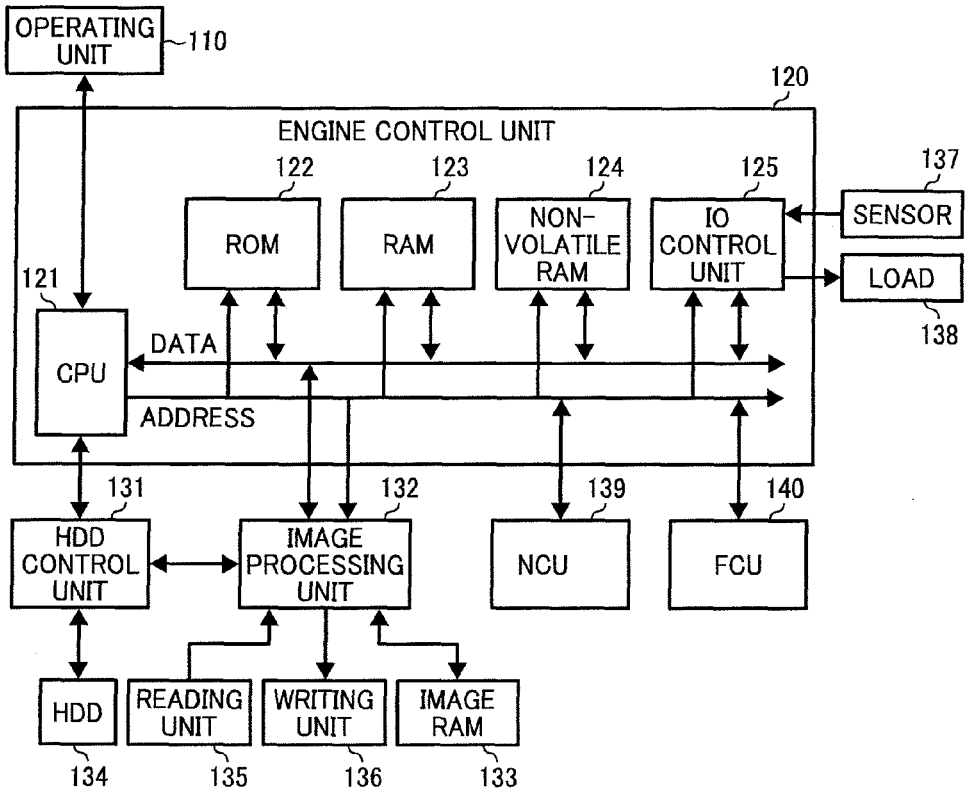
FIG. 3 is a block diagram of a circuit on a control board of the image forming apparatus as shown in FIG. 1.

FIG. 3 is a block diagram of a circuit on a control board of the image forming apparatus according to the present embodiment. The circuit includes an operating unit 110, an image processing unit 132, a hard disk drive (HDD) 134, a network controlling unit (NCU) 139, a facsimile controlling unit (FCU) 140, various sensors 137, and a load 138 that are connected to and centered on an engine control unit 120.

The engine control unit 120 includes a central processing unit (CPU) 121, and a read only memory (ROM) 122, a random access memory (RAM) 123, a non-volatile RAM 124, and an input output (I/O) control unit 125 that are connected to the CPU 121 via a data bus and an address bus. The ROM 122 stores therein a program code of a computer program executed by the CPU 121. The CPU 121 uses the RAM 123 as a work area and executes the computer program. The non-volatile RAM 124 stores therein data required while executing the computer program. The CPU 121 controls the HDD 134 that is connected to the CPU 121 via an HDD control unit 131.

A reading unit 135, a writing unit 136, and an image RAM 133 are connected to the image processing unit 132. Image data read by the reading unit 135 is input into the image processing unit 132 and a write image data is input into the writing unit 136 from the image processing unit 132. Image data that is temporarily stored in the image RAM 133 is read by the image processing unit 132, and image data read by the reading unit 135 is temporarily stored in the image RAM 133. The image processing unit 132 is also connected to the HDD control unit 131, so that image data stored in the HDD 134 is read by the image processing unit 132 and image data subjected to the image processing by the image processing unit 132 is stored in the HDD 134.

On a toner bottle for each color according to the present embodiment, an identification (ID) chip (Non-volatile memory radio frequency identification (RFID) chip) 149 is mounted. Due to this, data can be read or written from the CPU 121 of the engine control unit 120. The toner bottle is filled with the toner and is closed with a cap, which is the toner cartridge 30. A control board (hereinafter, "ID-read/write (R/W) board") 150 is arranged in the setting unit 9 for carrying out reading and writing with respect to the ID chip 149. The toner bottle is set in the setting unit 9 such that the toner bottle can communicate with the ID chip 149.

Figure 4:
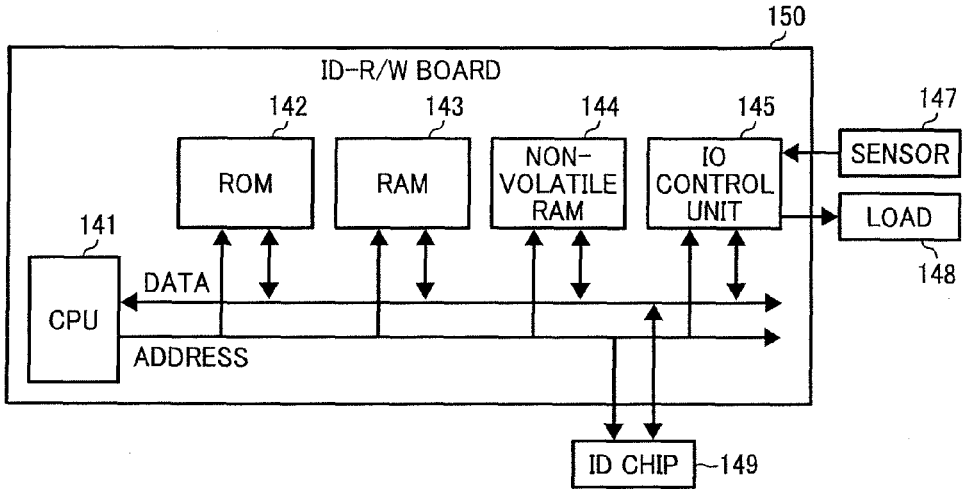
FIG. 4 is a block diagram of a circuit on an identification read/write (ID-R/W) board arranged in a setting unit of the image forming apparatus as shown in FIG. 1.

FIG. 4 is a block diagram of a circuit on the ID-R/W board 150. The ID-R/W board 150 includes a CPU 141, a ROM 142, a RAM 143, a non-volatile RAM 144, and an I/O controller 145 that are connected to the CPU 141 via a data bus and an address bus. The ROM 142 stores therein a program code of a computer program executed by the CPU 141. The CPU 141 uses the RAM 143 as a work area and executes the computer program. The non-volatile RAM 144 stores therein data that is required while executing the computer program by the CPU 141. The ID chip 149 is connected such that the ID chip 149 can carry out mutual wireless communication with the ID-R/W board 150. The ID chip 149 transmits and receives data via the data bus and the address bus. Thus, a I/O control unit (not shown) is arranged for carrying out wireless communication. Because a structure related to wireless communication between the ID chip 149 and the ID-R/W board 150 is a well-known structure, which is disclosed, for example, in Japanese Patent Application Laid-open No. 2007-148006, details are omitted. In the present embodiment, communication between the ID chip 149 and the setting unit 9 is carried out using wireless communication. However, communication between the ID chip 149 and the setting unit 9 can be carried out using a connector such that the connector is directly connected to the data bus and the address bus.

Figure 5:
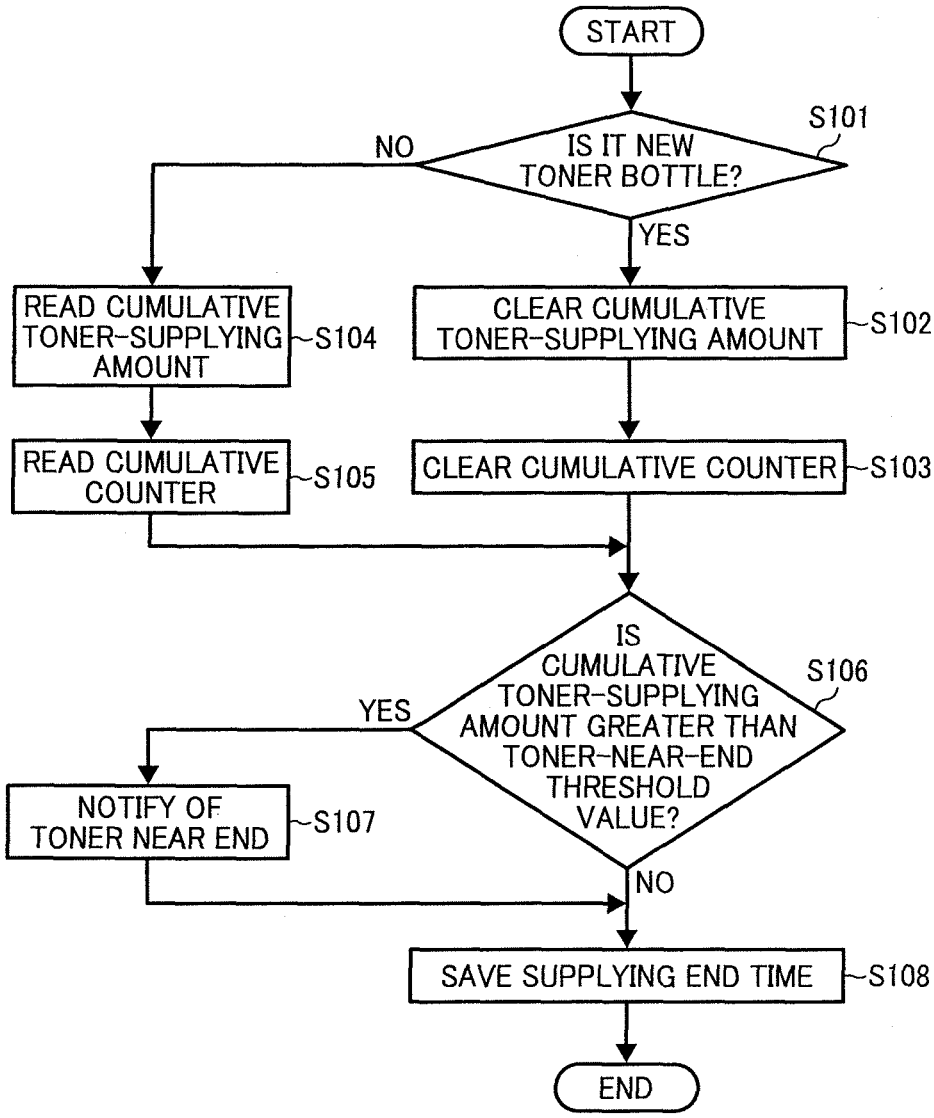
FIG. 5 is a flowchart for explaining a process performed when a toner bottle including an ID chip is replaced by a new one.

FIG. 5 is a flowchart for explaining a process performed by the CPU 121 of the engine control unit 120 when the toner bottle including the ID chip 149 is replaced.

In FIG. 5, upon starting the process, the CPU 121 of the engine control unit 120 accesses the CPU 141 of the ID-R/W board 150. The CPU 141 reads data stored in a memory of the ID chip 149 and transmits the data to the CPU 121. Based on the data, the CPU 121 checks whether the toner bottle is a new bottle (Step S101). If the toner bottle is a new bottle (Yes at Step 101), the CPU 121 initializes a cumulative toner usage amount of the ID chip 149. In other words, the CPU 121 clears a cumulative toner-supplying amount (Step S102) and subsequently, clears a cumulative counter (Step S103). However, based on the data read from the ID chip 149, if the toner bottle is not a new bottle, the cumulative toner usage amount of the bottle is used. In other words, the CPU 121 reads the cumulative toner-supplying amount (Step S104) and also reads the cumulative counter (Step S105). Upon reading the ID chip 149, if the cumulative toner-supplying amount is equal to or more than a toner-near-end threshold value (Yes at Step S106), the toner near end is notified to a user by displaying or the like (Step S107) and the process ends by saving a supplying end time (Step S108). However, if the cumulative toner-supplying amount is less than the toner-near-end threshold value (No at Step S106), the process ends by saving the supplying end time (Step S108) without notifying the user of the toner near end. The supplying end time is saved in the memory of the ID chip 149.

Figure 6:
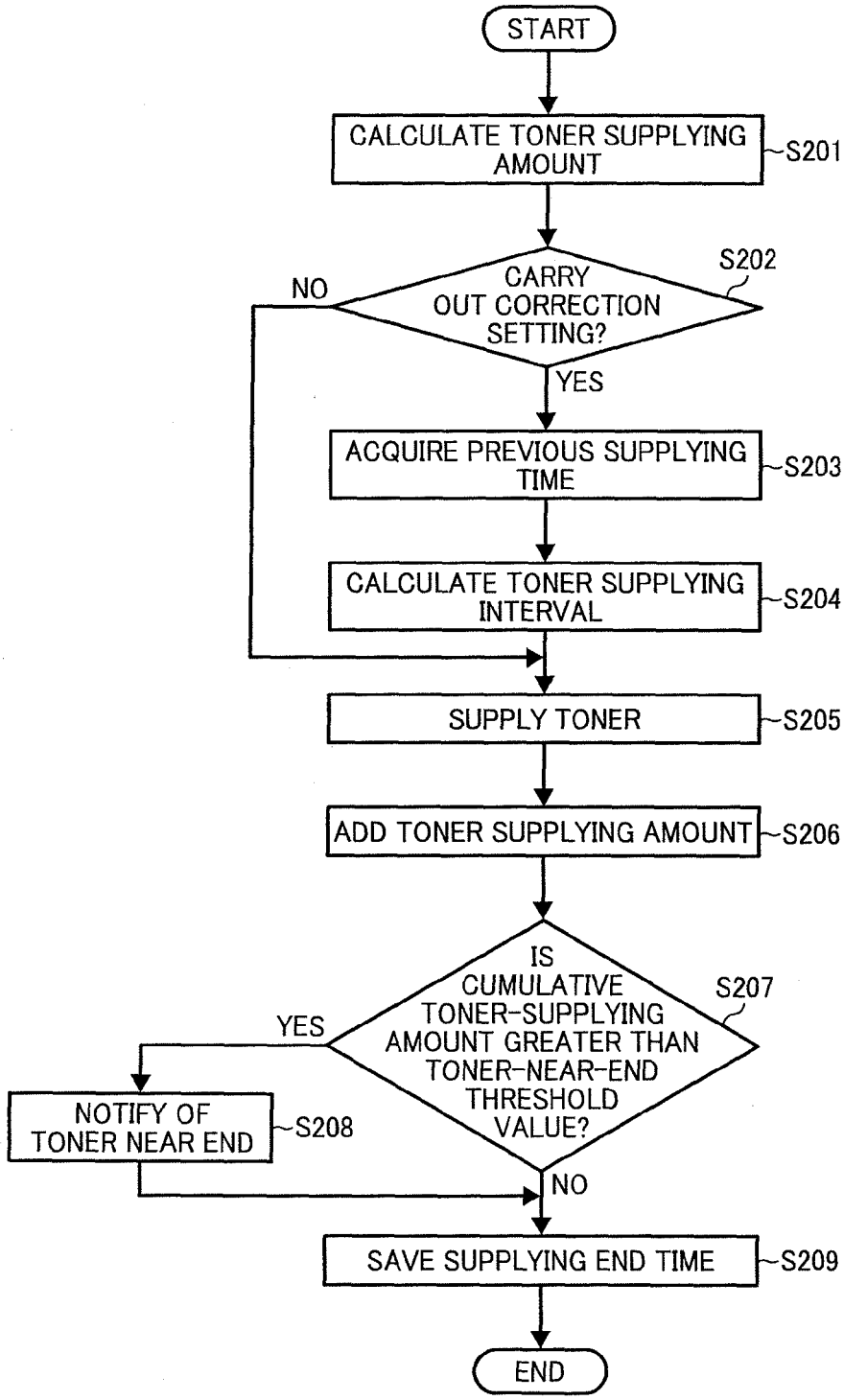
FIG. 6 is a flowchart for explaining a process performed at the time of supplying the toner.

FIG. 6 is a flowchart for explaining a process performed at the time of supplying the toner. Upon starting the supplying, first, the toner supplying amount is calculated (Step S201). For example, it is assumed that supply of 120 milligrams (mg) toner in 200 milliseconds (ms) is a default prior set toner supplying amount. In other words, the toner of 120 mg supplied in a supplying time period of 200 ms is assumed as the prior set toner supplying amount. Next, a correction setting (adjustment setting) is referred (Step S202). If correction (adjustment) is not to be carried out (No at Step S202), the toner supplying is carried out by using the default condition (Step S205) and the toner supplying amount is added without carrying out the correction (Step S206). The value of the added amount of the toner is saved in the ID chip 149.

If the correction is to be carried out (Yes at Step S202), the previous toner supplying time is acquired from the ID chip 149 (Step S203), and based on the previous toner supplying time, a toner supplying interval is calculated (Step S204). The toner supplying amount is calculated by referring to a table stored in the non-volatile RAM 144 in advance and the toner supplying is carried out (Step S205). The calculated toner supplying amount is the supplying amount that is stored in the table. Subsequently, the toner supplying amount is added (Step S206) and the cumulative toner-supplying amount is compared with the toner-near-end threshold value (Step S207). If the cumulative toner-supplying amount is greater than the toner-near-end threshold value (Yes at Step S207), the toner near end is notified to a user (Step S208). Upon notifying the toner near end, the process ends by saving the supplying end time (Step S209). If the cumulative toner-supplying amount is equal to or less than the toner-near-end threshold value (No at Step S207), the process ends by saving the supplying end time (Step S209) without notifying the user of the toner near end. The toner near end is notified by displaying it on an operation panel of the operating unit 110.

The toner supplying amount stored in the table is set by estimating a required toner supplying amount based on the previous toner supplying interval. In other words, every time the image forming operation is carried out on a single sheet, the toner is supplied based on the necessity. In the present embodiment, because the image forming apparatus is a four-color image forming apparatus, the toner supplying is carried out only for the time period of 200 ms for each color. In the present embodiment, the default toner supplying amount is 120 mg. Thus, if the toner supplying amount is large, the toner supplying interval becomes short. Thus, the toner supplying interval and the toner supplying amount of each color is set. The toner supplying interval is set by considering a printing rate and an output of a toner concentration sensor of the developing unit 11 for each color. In the present embodiment, as shown in FIG. 7, a relation between the toner supplying interval and the toner supplying amount is defined for each color of K, Y, C, and M. The relation between the toner supplying interval and the toner supplying amount is indicated in a table and the table is stored in the non-volatile RAM 144.

For example, when the toner supplying interval from the previous toner supplying end time to a current toner supplying is "a" (toner supplying interval is equal to or shorter than 3 seconds), in the current supplying, the toner supplying amount, which is by default 120 mg for 200 ms, is corrected to 125 mg for 200 ms for black (K) toner and toner supplying is carried out. When the toner supplying interval is "d" (toner supplying interval is between 20 seconds and 30 seconds), the toner supplying amount is corrected to 108 mg for 200 ms for yellow toner (Y) and the toner supplying is carried out. Thus, the toner supplying amount is calculated by referring to the table and the toner supplying is carried out.

In other words, the toner supplying amount that is used for supplying during a first correction is prior set as default value. Normally, based on the default value, the toner supplying is carried out in the interval that is based on the consumed amount. In other words, the toner near end can be estimated according to the toner supplying amount and the toner supplying interval. However, because the consumed toner amount differs, due to the printing rate or the like, depending on the toner supplying interval, the toner supplying amount is corrected. Thus, with respect to the toner supplying amount (for example, default toner supplying amount of 120 mg for 200 ms) that is set from the printing rate and the output of the toner concentration sensor of the developing unit 11 for each color, the toner supplying amount (toner supplying amount indicated in FIG. 7) is corrected by further considering the toner supplying interval. Consequently, a highly accurate toner near end is estimated by accumulating the corrected supplying amount.

In the present embodiment, the toner supplying amount is corrected based on the default value. A user can set from the operation panel of the operating unit 110, whether the toner supplying amount is to be corrected. FIG. 8A is a schematic diagram of a supplying-amount correcting screen 110*a* and FIG. 8B is a schematic diagram of a supplying-amount setting screen 110*b*. Upon selecting to carry out the correction in the supplying-amount correcting screen 110*a* shown in FIG. 8A, a user can set the toner supplying amount by shifting to the supplying-amount setting screen 110*b* shown in FIG. 8B. For example, if the toner supplying amount of the yellow toner is set to another value from 120 mg when the toner supplying interval is 0 second to 3 seconds, and if the other value is entered using a numerical keypad 110*c* from the supplying-amount setting screen 110*b*, the other value is displayed in a display column 110*d*. Accordingly, the corrected amount changes as in the table shown in FIG. 7. Although the other value is entered during 3 seconds to 6 seconds using the numerical keypad 110*c*, the other value is displayed in a display column 110*e* and changed.

Thus, according to the embodiment of the present invention, a difference between an actual toner usage amount of each color and the estimated toner usage amount is reduced and the highly accurate toner near end can be detected without using a toner near-end sensor. Due to this, a cost can also be reduced.

The present invention in its broader aspects is not limited to the specific details and representative embodiments shown and described herein. Accordingly, various modifications may be made without departing from the spirit or scope of the general inventive concepts as defined by the appended claims and their equivalents.

According to an aspect of the present invention, detection accuracy of a toner near end can be enhanced without using a sensor.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a toner supplying unit that supplies toner from a toner container to a developing unit;

a timer unit that measures a time interval between a current time and a time point when previous supply of toner by the toner supplying unit to the developing unit ended; and an adjusting unit that adjusts an amount of toner to be supplied by the toner supplying unit to the developing unit based on the time interval measured at the timer unit.

2. The image forming apparatus according to claim 1, wherein the adjusting unit adjusts the amount of toner to be supplied by the toner supplying unit to the developing unit based on a color of the toner.

3. The image forming apparatus according to claim 1, further comprising a setting unit that sets whether or not to perform adjustment of the amount of toner to be supplied by the toner supplying unit.

4. The image forming apparatus according to claim 1, further comprising an input unit that receives input of the amount of toner to be supplied by the toner supplying unit.

5. The image forming apparatus according to claim 1, further comprising a determining unit that determines whether the toner container is replaced by a new toner container or replaced by a used toner container, wherein the adjusting unit resets the time interval when the determining unit determines that the toner container is replaced by a new toner container, and does not reset the time interval when the determining unit determines that the toner container is replaced by a used toner container.

6. An image forming method comprising:

supplying toner from a toner container to a developing unit;

measuring a time interval between a current time and a time point when previous supply of toner at the supplying ended; and adjusting an amount of toner to be supplied at the supplying based on the time interval measured at the measuring.

7. The image forming method according to claim 6, wherein the adjusting includes adjusting the amount of toner to be supplied at the supplying based on a color of the toner.

8. The image forming method according to claim 6, further comprising setting whether or not to perform adjustment of the amount of toner to be supplied at the supplying.

9. The image forming method according to claim 6, further comprising receiving input of the amount of toner to be supplied at the supplying.

10. The image forming method according to claim 6, further comprising determining whether the toner container is replaced by a new toner container or replaced by a used toner container, wherein the adjusting includes resetting the time interval when it is determined at the determining that the toner container is replaced by a new toner container, and maintaining the time interval when it is determined at the determining that the toner container is replaced by a used toner container.

* * * * *